US009957980B2

(12) United States Patent
Englebert

(10) Patent No.: US 9,957,980 B2
(45) Date of Patent: May 1, 2018

(54) VANE WITH SEALED LATTICE IN A SHROUD OF AN AXIAL TURBOMACHINE COMPRESSOR

(71) Applicant: Techspace Aero S.A., Herstal (Milmort) (BE)

(72) Inventor: Eric Englebert, Villers-le-Bouillet (BE)

(73) Assignee: SAFRAN AERO BOOSTERS SA, Herstal (Milmort) (BE)

( * ) Notice: Subject to any disclaimer, the term of this patent is extended or adjusted under 35 U.S.C. 154(b) by 304 days.

(21) Appl. No.: 14/808,256

(22) Filed: Jul. 24, 2015

(65) Prior Publication Data

US 2016/0025108 A1 Jan. 28, 2016

(30) Foreign Application Priority Data

Jul. 25, 2014 (EP) ..... 14178502

(51) Int. Cl.
*F04D 29/64* (2006.01)
*F04D 29/54* (2006.01)
(Continued)

(52) U.S. Cl.
CPC ..... *F04D 29/644* (2013.01); *F01D 9/042* (2013.01); *F01D 11/001* (2013.01);
(Continued)

(58) Field of Classification Search
CPC ... F01D 9/02; F01D 9/04; F01D 9/042; F01D 11/001; F01D 11/02; F04D 19/022;
(Continued)

(56) References Cited

U.S. PATENT DOCUMENTS 2,772,069 A * 11/1956 Hockert ..... F01D 9/042 415/134
3,708,242 A * 1/1973 Bruneau ..... F01D 9/044 415/200
3,932,056 A * 1/1976 Tai ..... F01D 5/225 415/191
4,305,696 A * 12/1981 Pask ..... F01D 9/042 415/191

(Continued)

FOREIGN PATENT DOCUMENTS

EP 2418387 A1 2/2012
EP 2735707 A1 5/2014

OTHER PUBLICATIONS

Search Report dated Jan. 8, 2015 from European Patent Appl. No. 14178502.2.

*Primary Examiner* — Woody Lee, Jr.
*Assistant Examiner* — Elton Wong
(74) *Attorney, Agent, or Firm* — James E. Walton

(57) ABSTRACT

The present application relates to a stator of an axial turbomachine compressor. The stator includes a circular wall, such as an internal shroud, with a guiding surface in order to guide the primary flow of the turbomachine. The stator further includes a circular row of stator vanes, each of them including an airfoil which extends radially in the primary flow of the turbomachine, and a securing portion. The securing portion of the vane includes a lattice which has rods and which is secured and/or sealed in the shroud in order to fix the vanes to the shroud via the lattices. The stator includes a joint of abradable material which is arranged inside the internal shroud, and in which the lattice is secured in order to ensure retention, a fixing between the vane and the internal shroud. The vane is produced by means of additive production.

17 Claims, 2 Drawing Sheets

(51) Int. Cl.

| | |
|---|---|
| ***F04D 29/10*** | (2006.01) |
| ***F04D 29/08*** | (2006.01) |
| ***F04D 19/02*** | (2006.01) |
| ***F01D 9/04*** | (2006.01) |
| ***F01D 11/00*** | (2006.01) |

(52) U.S. Cl.
CPC ..... *F04D 19/022* (2013.01); *F04D 29/083* (2013.01); *F04D 29/102* (2013.01); *F04D 29/542* (2013.01)

(58) Field of Classification Search
CPC .... F04D 29/083; F04D 29/102; F04D 29/542; F04D 29/644
See application file for complete search history.

(56) References Cited

U.S. PATENT DOCUMENTS

| | | | | |
|---|---|---|---|---|
| 4,861,229 | A * | 8/1989 | Halstead | F01D 5/284 415/138 |
| 5,181,827 | A * | 1/1993 | Pellow | F01D 25/246 415/134 |
| 2008/0206049 | A1* | 8/2008 | Depaepe | F01D 9/042 415/208.1 |
| 2010/0150708 | A1* | 6/2010 | Cortequisse | F01D 9/042 415/200 |
| 2012/0301691 | A1* | 11/2012 | Charleux | C04B 35/52 428/213 |
| 2013/0108427 | A1* | 5/2013 | Brassine | B29C 45/16 415/200 |
| 2013/0129494 | A1* | 5/2013 | Duchaine | F01D 9/041 415/191 |

* cited by examiner

VANE WITH SEALED LATTICE IN A SHROUD OF AN AXIAL TURBOMACHINE COMPRESSOR

This application claims priority under 35 U.S.C. § 119 to European Patent Application No. 14178502.2, filed 25 Jul. 2014, titled "Vane with Sealed Lattice in a Shroud of an Axial Turbomachine Compressor," which is incorporated herein by reference for all purposes.

BACKGROUND

1. Field of the Application

The present application relates to a stator stage of an axial turbomachine. More specifically, the present application relates to the fixing between a shroud and a stator vane of an axial turbomachine. The present application also relates to an axial turbomachine which is provided with a stator vane.

2. Description of Related Art

A turbomachine provides mechanical work as a result of the gas flows which pass through it. These flows are guided by housings and series of internal shrouds. The internal shrouds are generally connected to the housing of the turbomachine via the stator vanes. The vanes have internal ends with fixing portions to which the shrouds are connected. It is known, for example, to secure a shroud to an annular row of vanes using a retention rod.

Document EP 2735707 A1 discloses a rectifier of an axial turbomachine compressor. The rectifier comprises an external housing, an annular row of vanes which extend radially from the housing, and an internal shroud which is connected to the inner ends of the vanes. These vane ends each have a retention hook in which a retention rod is engaged. The rod and the hooks are embedded in a layer of abradable material which is applied to the inner side of the vane, which allows the shroud to be retained. The retention provided by this architecture is great; it is particularly resistant to occurrences of intake. However, it requires the addition of a retention rod which increases the assembly costs and makes the rectifier heavier. In the context of a segmented shroud, the shroud may tilt about the rod. The abradable material which surrounds the rod in the region of the rod is thus subjected to high levels of stress and may become damaged.

Although great strides have been made in the area of stator stages of axial turbomachine compressors, many shortcomings remain.

DETAILED DESCRIPTION OF THE PREFERRED EMBODIMENT

Figure 1:
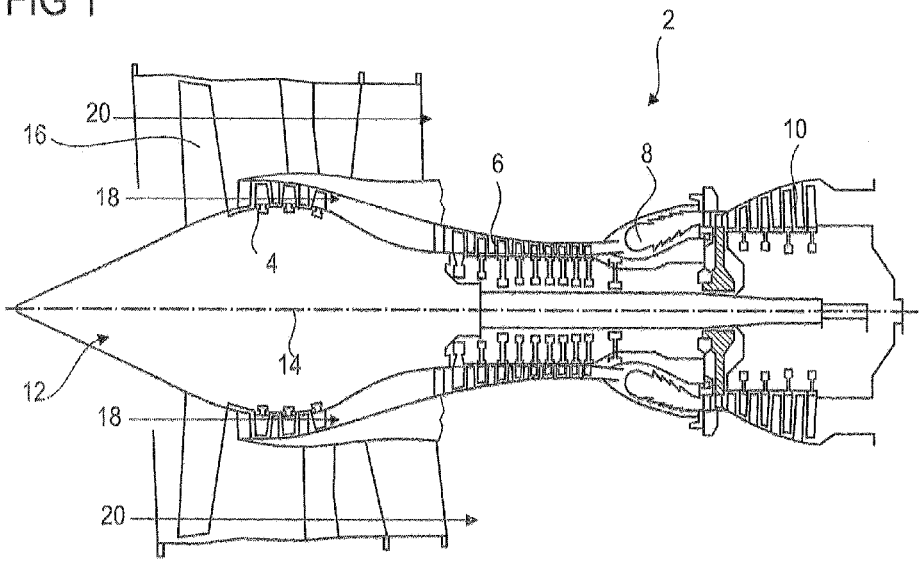
FIG. 1 shows an axial turbomachine according to the present application.

The present application aims to solve at least one of the problems presented by the prior art. More specifically, an object of the present application is to improve the securing between a vane and a wall. An object of the present application is also to reduce the costs of assembling a stator with a wall which is connected to vanes whilst improving the securing and optimising the distribution of the forces between a vane and a wall.

The present application relates to a stator of an axial turbomachine, in particular of a compressor, the stator comprising: a wall which is circular or in the form of a circular arc, the wall comprising a guiding surface which is intended to guide a flow of the turbomachine; a circular or semi-circular row of stator vanes, at least one of the stator vanes comprising a airfoil which is intended to extend radially in the flow from the guiding surface and a securing portion which extends from the guiding surface radially opposite the airfoil; remarkable in that the securing portion of the vane comprises a lattice which is secured to the wall in order to fix the vane to the wall via the lattice.

According to an advantageous embodiment of the present application, the lattice is a three-dimensional lattice with interwoven rods which are joined to each other so as to form meshes, the lattice comprising a plurality of meshes over the thickness and/or the length of the airfoil and/or in the radial direction.

According to an advantageous embodiment of the present application, the at least one vane comprises a leading edge, a trailing edge, an intrados surface and an extrados surface, the intrados surface and the extrados surface extending from the leading edge to the trailing edge; and the lattice extending from the leading edge to the trailing edge of the airfoil, and from the intrados surface to the extrados surface.

According to an advantageous embodiment of the present application, the wall is an internal shroud or a segment of internal shroud, preferably the internal shroud and/or the wall is produced from a composite material having an organic matrix.

According to an advantageous embodiment of the present application, the wall comprises at least one opening in which the securing portion is arranged, preferably the lattice extends radially beyond the opening, more preferably the lattice is radially spaced apart from the opening.

According to an advantageous embodiment of the present application, the wall is integral with and is formed by a material which fills the lattice.

According to an advantageous embodiment of the present application, the stator comprises a sealing joint which is placed against the wall radially opposite the guiding surface, the lattice being at least partially secured in the radial thickness of the joint, optionally the joint comprises a matrix and balls which are in contact with the lattice.

According to an advantageous embodiment of the present application, the joint comprises a layer of abradable material which is intended to cooperate by means of abrasion with the rotor of the turbomachine, the lattice being at least partially arranged in the radial thickness of the layer of abradable material, optionally the layer of abradable material comprises a silicone material.

According to an advantageous embodiment of the present application, the lattice extends over the majority of the axial length of the wall and/or the radial height of the wall.

According to an advantageous embodiment of the present application, the airfoil comprises a solid body which extends over the majority of the radial height thereof, preferably at least over the entirety of the radial height thereof.

According to an advantageous embodiment of the present application, the lattice comprises a compactness which is less than 60%, preferably less than 30%, more preferably less than 10%.

According to an advantageous embodiment of the present application, the securing portion is a first securing portion, and the lattice is a first lattice, the wall is a first wall, the at least one vane further comprising a second securing portion with a second lattice which is radially opposite the first lattice relative to the airfoil and which is secured in a second wall which is concentric with the first wall.

According to an advantageous embodiment of the present application, the vane comprises a fixing platform, optionally with a fixing shaft, which is arranged radially opposite the lattice relative to the airfoil; the stator preferably comprises an external housing, the platform being fixed to the external housing.

According to an advantageous embodiment of the present application, the airfoil, the lattice and optionally the fixing platform are integral and are produced by means of additive production, preferably based on titanium powder.

According to an advantageous embodiment of the present application, the guiding surface is radially at a height between the airfoil and the securing portion.

According to an advantageous embodiment of the present application, at least one or each securing portion is connected to a airfoil.

According to an advantageous embodiment of the present application, the wall comprises an upstream axial half and a downstream axial half, preferably the lattice is axially spaced apart from one of the axial halves, optionally spaced apart from the upstream half.

According to an advantageous embodiment of the present application, the wall may be annular or generally tubular, or form an angular ring portion or tube portion.

According to an advantageous embodiment of the present application, the securing portion comprises a network of channels which extends through the securing portion and the lattice, optionally axially and/or laterally.

According to an advantageous embodiment of the present application, the lattice comprises a regular mesh; or the mesh is variable, optionally the mesh becomes denser in the direction radially away from the airfoil, or becomes denser in the region of the leading edge or trailing edge.

According to an advantageous embodiment of the present application, the lattice and the wall are produced from different materials.

According to an advantageous embodiment of the present application, the lattice is filled with a polymer material, such as an elastomer resin.

According to an advantageous embodiment of the present application, the lattice comprises at least one rod which extends over the majority, preferably the whole, of the length or the width of the vane.

According to an advantageous embodiment of the present application, the lattice comprises at least two sets, preferably at least three sets of parallel rods, each set comprising rods which are perpendicular to the rods of the other sets.

According to an advantageous embodiment of the present application, the lattice comprises at least four sets of parallel rods, each set comprising rods which are orientated at 60° relative to the rods of the other sets.

According to an advantageous embodiment of the present application, the lattice extends over the majority, preferably over the whole, of the axial length and/or the thickness of the airfoil.

According to an advantageous embodiment of the present application, in the state not secured to the shroud, the lattice is mostly empty, preferably 75% empty, more preferably 90% empty.

The compactness of the lattice is understood to be the ratio between the volume which is occupied by the material which forms the lattice and the total volume in which the lattice is arranged.

According to an advantageous embodiment of the present application, the lattice is less long axially than the opening or each opening.

According to an advantageous embodiment of the present application, the airfoil and each securing portion form a radial stack.

The present application also relates to a turbomachine, comprising a stator, remarkable in that the stator is in accordance with the present application, optionally the wall comprises an upstream axial half and a downstream axial half, preferably the lattice is axially spaced apart from one of the axial halves, optionally spaced apart from the upstream half.

The present application enables the stability of the securing between a vane and a wall to be improved. The present application increases and distributes the contact surface between the securing portion and the wall; optionally via the joint, so that the inclined and asymmetrical shrouds as on the first rectifier and on the last rectifier are more stable. The lattice distributes the forces between the vane and the wall. The compactness thereof which is lower than that of the airfoil reduces the mass of the stator.

The lattice forms a zone of reduced rigidity in the vane, it is more flexible and can absorb, damp an impact by limiting the energy transmitted to the wall. The rods may be inclined relative to the radial direction in order to promote the radial extension of the lattice and to further reduce the energy transmitted in the case of a radial tearing force. In this manner, the retention and the fixing become more reliable.

The use of a lattice is compatible with a moulding of a wall or a joint on the securing portions. This solution reduces the assembly costs for a specific retention resistance.

In the following description, the terms inner or internal and outer or external refer to a positioning relative to the rotation axis of an axial turbomachine.

FIG. 1 shows an axial turbomachine in a simplified manner. In this particular instance, it is a dual-flow turboreactor. The turboreactor 2 comprises a first compression level, referred to as a low-pressure compressor 4, a second compression level, referred to as a high-pressure compressor 6, a combustion chamber 8 and one or more turbine levels 10. During operation, the mechanical power of the turbine 10 transmitted via the central shaft to the rotor 12 causes the two compressors 4 and 6 to move. Step-down means may increase the rotation speed transmitted to the compressors. Alternatively, the different turbine stages may each be connected to the compressor stages via concentric shafts. They comprise several rows of rotor vanes which are associated with rows of stator vanes. The rotation of the rotor about the rotation axis 14 thereof thus allows a flow of air to be generated and compressed progressively as far as the inlet of the combustion chamber 8.

An inlet ventilator which is generally referred to as a fan or blower 16 is coupled to the rotor 12 and generates a flow of air which is divided into a primary flow 28 which passes through the different above-mentioned levels of the turbomachine, and a secondary flow 20 which passes through an annular conduit (partially illustrated) along the machine in order to then join the primary flow at the outlet of the turbine. The secondary flow may be accelerated in order to generate a reaction. The primary flow 18 and secondary flow 20 are annular flows, they are channelled via the housing of the turbomachine. To this end, the housing has cylindrical walls or shrouds which may be internal and external.

Figure 2:
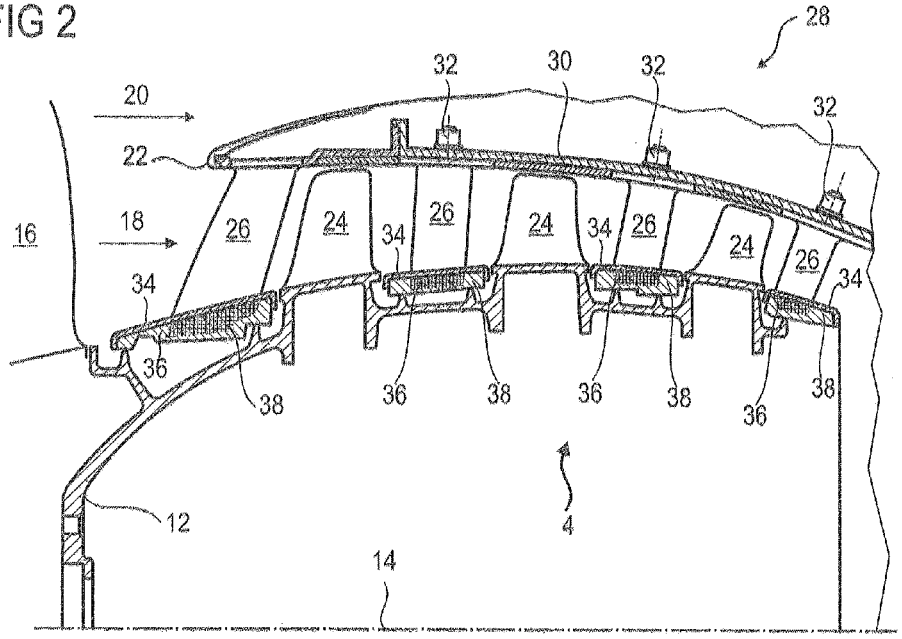
FIG. 2 is a diagram of a turbomachine compressor according to the present application.

FIG. 2 is a sectioned view of a compressor of an axial turbomachine 2 such as that of FIG. 1. The compressor may be a low-pressure compressor 4. It is possible to observe therein a portion of the fan 16 and the separation nose 22 of the primary flow 18 and the secondary flow 20. The rotor 12 comprises a plurality of rows of rotor blades 24, in this instance three.

The compressor 4 comprises a plurality of rectifiers, in this instance four, which each contain a row of stator vanes 26. The rectifiers are associated with the fan 16 or with a row of rotor blades 24 in order to rectify the flow of air, in order to convert the flow speed into pressure.

The compressor comprises a stator 28, optionally with an external housing 30 which forms a partition which supports the separation nose 22. The partition supports the rectifiers and annular layers of abradable materials which are arranged between the rectifiers. The external housing 30 may be circular or annular and/or be formed by half-shells. It may be produced from composite material having an organic matrix. The stator vanes 26 extend substantially radially from the partition of the outer housing 30, and may be fixed at that location using a through-shaft 32.

The stator 28 comprises at least one wall 34, preferably a plurality of walls, such as internal shrouds 34 which are connected to the inner ends of the stator vanes 26 via securing portions. The wall 34 and the external housing 30 are concentric. The securing portion of at least one stator vane 26 comprises a lattice 36, preferably each vane of a row of stator vanes 26 comprises a securing portion with a lattice 36, more preferably each stator vane 26 of at least one compressor 4 of the turbomachine comprises a securing portion having a lattice 36. The or each lattice 36 may be secured or sealed to the wall 34 and/or to the inner shroud 34.

The stator 28 may comprise at least one joint 38 which is associated with the wall 34 or each wall 34. The or each lattice 36 may be engaged in the joint 38 in order to be secured at that location and to form a fixing between a stator vane 26 and the joint 38, and therefore between a stator vane 26 and the associated wall 34. The stator 28 illustrated is that of the compressor, but the present application could be used equally well for a turbine stator or for a stator of a turbomachine blower.

Figure 3:
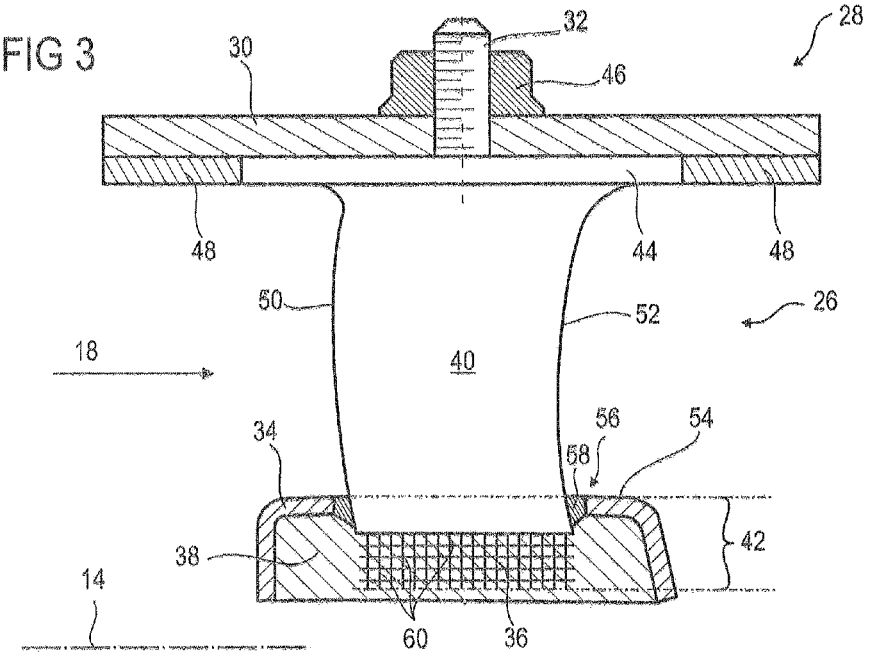
FIG. 3 is a cross-section of a turbomachine stator according to the present application, when viewed in profile.

FIG. 3 shows the stator 28. It is possible to see therein an internal shroud which is connected to the external housing 30 via a stator vane 26, the lattice 36 of the vane is accommodated in the joint 38.

The vane or each vane 26 comprises a plurality of radial portions, including a airfoil 40 which extends radially in the flow and at least one securing portion 42. The vane 26 may optionally comprise a fixing platform 44 which forms an assembly support. The platform 44 may be fixed to the external housing 30 using the fixing shaft 32 thereof and a lockbolt 46, or have holes which coincide with holes of the external housing. It may be a plate which is rectangular or in the form of a parallelogram, and may be bordered axially by annular layers 48 of abradable material upstream and downstream. The platform 44 may be pressed against the external housing 30 and/or may conform to the external housing 30, optionally over the majority of the length thereof. The vane comprises a leading edge 50 which is connected to the trailing edge 52 via the intrados surface and the extrados surface. The vane 26 may be inwardly curved, cambered.

The wall 34 may be the internal shroud 34. The wall may comprise a guiding surface 54 for guiding and delimiting a flow, such as the primary flow 18 of the turbomachine. This surface is generally annular, optionally substantially cylindrical, and may be segmented angularly. It extends over the entire length of the airfoil 40, and may extend beyond in an upstream and downstream direction The wall 34 may comprise at least one opening 56 or a row of openings 56, each opening 56 receiving a securing portion 42 for a vane 26 in order to fix it, in particular by means of securing. This fixing can be carried out in different manners, for example, with a rod. The space between the opening 56 through which the vane 26 passes and the airfoil 40 may be closed using a bead of silicone 58 in order to prevent leakages. The securing portion 42 may comprise a smooth portion in order to cooperate with the bead 58, the lattice being radially recessed relative to the bead 58 and/or the opening 56. The airfoil 40 may extend radially towards the outer side from the wall 34, from an opening 56. Alternatively, the wall may comprise pockets in which the lattices are secured.

The wall may have a web with a profile which is formed by means of revolution about the rotation axis 14 in the form of an inverted "U", with an axial portion, such as a sleeve, extended radially and delimited axially by radial portions. The web may delimit an internal annular space. The wall 34 may be metal or of composite material with an organic matrix in order to reduce the mass whilst optimising the rigidity. The wall 34 may be circular or form a circular arc. It may be a shroud segment, that is to say, be in the form of an angular sector of a circle. In this instance, a stator forms a circle as a result of a plurality of segments which are placed end-to-end.

The stator 28 may comprise an annular or semi-annular sealing joint 38 which is arranged against the wall 34, opposite the airfoil 40 relative to the guiding surface 54. This joint 38 may be placed in the annular space of the web of the wall 34, and may fill this space. It may surround the ends of vanes 26 or airfoils 40, and may be introduced in the or each securing portion 42. The joint 38 may be an elastomer material which forms a matrix, such as silicone. It may be an annular layer of abradable material which is capable of crumbling in the case of contact with the rotor. It may comprise a matrix and particles, such as balls, in order to promote the brittle nature of the joint. These balls may cooperate with the lattice and be configured to improve the securing.

The or each lattice 36 may form the internal end, the tip of the vane 26. The or each lattice 36 may comprise rods 60 which are connected to each other. They may be straight or curved. They may be connected to each other at the intersections thereof. The rods 60 may form at the intersections thereof nodes which are optionally integrated in their cross-sections. The lattice may be integral.

The or each lattice 36 may be planar, and/or formed over a skewed surface, for example, parallel with the radial extension of the intrados surface or the extrados surface. It may be substantially bi-directional, for example, having flat meshes which are formed by the rods 60 thereof. The or each lattice may be three-dimensional and have polyhedral meshes whose edges are formed by the rods 60. The meshes may be tetrahedrons and/or cubes. The rods 60 thereof may be arranged in accordance with at least three directions, for example, perpendicular to each other. The rods 60 may form sets of rods 60 which have the same directions, and/or the same curvatures.

The or each lattice 36 may extend in the radial extension of the airfoil 40. It may extend between the leading edge 50 and the trailing edge 52, optionally it extends beyond these edges. It may extend over the majority, preferably over the whole of the chord of the airfoil 40 in the region of the guiding surface 54. The or each lattice 36 may form a plurality of meshes over the airfoil 40, preferably at least ten meshes, more preferably at least fifty meshes. The or each lattice 36 may extend over the majority of the axial length of the wall 34. The axial extension of the lattice 36 allows the tilting of the wall 34 relative to the vane 26 to be limited, which may occur when the wall is short over the circumference. At least one rod 60 or a set of rods 60 may extend over the majority, optionally over the axial entirety of the airfoil 40, and/or the securing portion 42.

The or each lattice 36 may have a variable heterogeneous mesh. The meshes may become tighter towards the airfoil 40, and optionally in the region of the leading edge 50 and the trailing edge 52, for example, in order to increase the forces which the rods 60 of the lattice 36 can transmit in the event of intake. The rods 60 may increase in number and/or become more fine towards the inner side. The compactness of each lattice 36 is less than 90%, preferably less than 50%, more preferably less than 5%. The compactness may double from one end to the other. It may vary by 10%, preferably by 30%. Alternatively, the mesh may be constant, homogeneous, optionally locally.

The or each lattice 36 may be secured in the joint 38 and/or in the very material which forms the wall 34 and the guiding surface 54. The lattice 36 is embedded in the material of the joint 38, the rods 60 merge at the joint 38. The joint 38 is introduced in and occupies the meshes of the lattice in order to fill them. In this manner, the joint 38 completely fills the space that the lattice, via the rods thereof, does not occupy. All these properties of the joint can be transposed to the material of the wall. The joint 38 may be moulded on the wall, or even projected. The lattice 36 may extend over the majority of the thickness of the profile of the joint 36 as formed by means of revolution. This securing depth in the joint improves the retention and the sealing effect.

Figure 4:
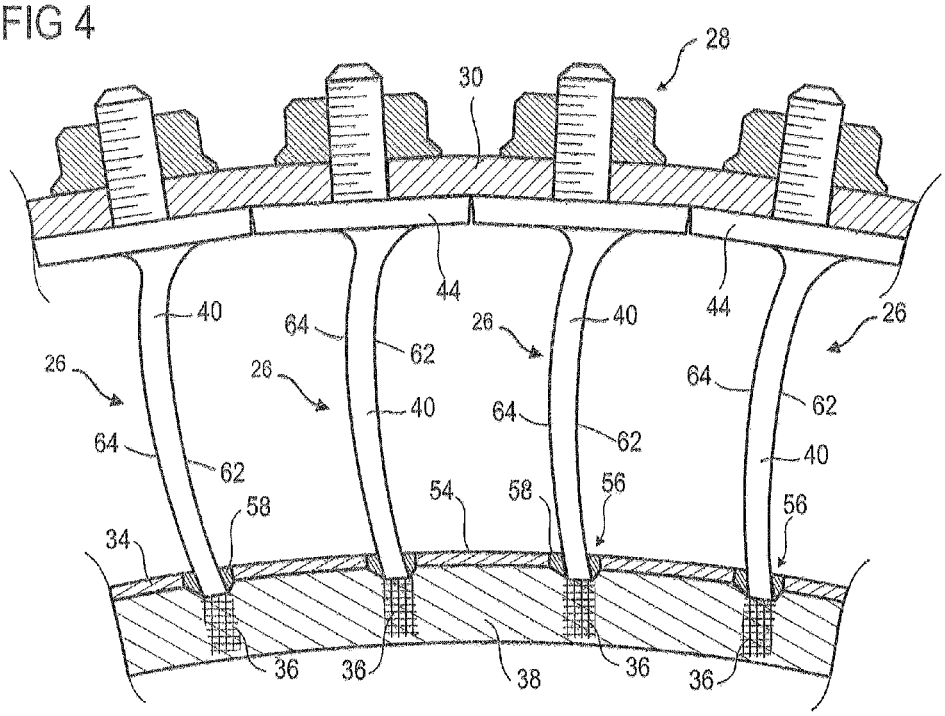
FIG. 4 is a cross-section of a portion of a turbomachine stator according to the present application, when viewed axially.

FIG. 4 shows a portion of the stator 28 of the turbomachine. A row of stator vanes 26 which fix a wall 34 to another wall 30 via lattices 36 which are fixedly joined to the joint 38 is shown.

The row of vanes may be an annular or semi-annular row; that is to say, which describes an angular sector of a circle. The platforms 44 may be in contact with each other as a result of the lateral edges thereof in order to position the vanes 26, and therefore the wall 34. At least one or each lattice 36 may extend radially in the extension of the thickness of the airfoil 40, the thickness being able to be understood in accordance with the circumference. At least one or each lattice 36 may extend the aerodynamic profile of the airfoil 40 in the region of the guiding surface 54, optionally reproducing the cambered appearance of the profile.

At least one or each lattice 36 may form a plurality of meshes over the thickness of the airfoil 40, for example, at least two, preferably at least five, more preferably at least ten meshes. At least one or each lattice 36 may have, radially in the region of the maximum thickness thereof, a plurality of rods which extend mainly axially. The lattice 36 may be wider than the airfoil 40 and less wide than the associated opening 56.

The height of at least one or each lattice 36 may be greater than the maximum thickness of the airfoil 40, preferably at least three times greater. At least one or each lattice 36 may be radially spaced apart from the associated opening 56, and/or the internal surface of the joint 38. At least one or each lattice 36 may have a general envelope whose surfaces are inclined relative to the intrados surface 62 and the extrados surface 64 of the associated vane in the region of the guiding surface 54.

The presence of fixing platforms 44 is entirely optional, since each vane may comprise two lattices in order to be secured to two walls. At least one or each vane 26 of the row may comprise a first internal securing portion which is secured by means of the first lattice thereof to the internal shroud 34, and a second external securing portion which is secured by means of a second lattice to the external housing 30. The lattices are separated by the airfoil, each of them may be secured in the thickness of the web of the external housing, in particular when it is moulded.

At least one or each vane 26, in particular the airfoil 40 thereof, the lattice 36 thereof and optionally the platform 44 thereof; or the airfoil thereof and the lattices thereof are integral and may be produced by means of additive production. They can be produced based on titanium powder or polymer in order to form an integral assembly. The vane may form an integral element with a mixed structure, having a airfoil which is solid and a lattice which is partially empty.

The vane may be produced in the form of a row of vanes, with at least one or more vanes having a securing lattice, and optionally other means for fixing at the same radial side as the lattices on other vanes. In this alternative embodiment, the row of vanes may have a common platform having a plurality of airfoils.

I claim:

1. An axial turbomachine stator, comprising:

an annular wall with a guiding surface for guiding an annular flow of the turbomachine;

a circular row of stator vanes, at least one of the stator vanes comprising:

an airfoil which is intended to extend radially in the flow from the guiding surface; and a securing portion which extends from the guiding surface radially opposite the airfoil, and which is secured to the wall;

wherein the securing portion of the vane comprises:

a lattice secured to the wall within the wall's radial thickness in order to fix the vane to the wall via the lattice wherein the lattice is a three-dimensional lattice with interconnected rods which are joined to each other so as to form meshes, the lattice comprising:

a plurality of meshes over the thickness and over the length of the airfoil and in the radial direction.

2. The axial turbomachine stator in accordance with claim 1, wherein the at least one vane comprises:

a leading edge, a trailing edge, an intrados surface, and an extrados surface, the intrados surface and the extrados surface extending from the leading edge to the trailing edge, and the lattice extending at least from the leading edge to the trailing edge, and from the intrados surface to the extrados surface of the airfoil.

3. The axial turbomachine stator in accordance with claim 1, wherein the wall comprises:

a sealing joint layer, the lattice being at least partially secured in the radial thickness of the sealing joint layer.

4. The axial turbomachine stator in accordance with claim 1, wherein the wall comprises:

at least one opening in which the securing portion is fixed, the lattice extending radially beyond the opening.

5. The axial turbomachine stator in accordance with claim 1, wherein the wall is formed by an annular array of angular segments to which the lattice is secured.

6. The axial turbomachine stator in accordance with claim 1, wherein the guiding surface is radially at a height between the airfoil and the securing portion, the lattice forming the vane's radial end.

7. The axial turbomachine stator in accordance with claim 1, wherein the wall is integral with and is formed by a material which fills the lattice.

8. The axial turbomachine stator in accordance with claim 1, wherein the lattice extends over the majority of the axial length of the wall and over the majority of the radial thickness of the wall.

9. The axial turbomachine stator in accordance with claim 1, wherein the airfoil comprises:

a solid body which extends over the majority of the radial height thereof, the lattice being broader in the circumferential direction than said airfoil.

10. The axial turbomachine stator in accordance with claim 1, wherein the lattice comprises:

a compactness which is less than one of the group consisting:

60%;

30%; and

10%.

11. The axial turbomachine stator in accordance with claim 1, wherein the securing portion is a first securing portion, and the lattice is a first lattice, the wall is a first wall, the stator further comprising:

a second wall which is concentric with the first wall, the at least one vane further comprising:

a second securing portion with a second lattice which is radially opposite the first lattice relative to the airfoil and which is secured in the second wall.

12. The axial turbomachine stator in accordance with claim 1, wherein the airfoil and the lattice are integral and are produced by means of additive manufacturing.

13. An axial flow turbine engine compressor, comprising:

an annular vein guiding an axial annular flow; and a stator comprising:

an annular wail comprising:

an annular guiding surface guiding said axial annular flow; and a circular row of stator vanes, at least one of the stator vanes comprising:

an airfoil extending radially through the axial annular flow from the guiding surface; and a securing portion, the airfoil and the securing portion being radially stacked;

wherein the securing portion of the vane comprises:

a lattice which is secured to the wall in order to fix the vane to the wall via the lattice, the guiding surface being radially placed between the lattice and the airfoil of said vane, wherein the lattice is a three-dimensional lattice with interconnected rods which are joined to each other so as to form meshes, the lattice comprising a plurality of meshes over the thickness and over the length of the airfoil and in the radial direction, wherein the stator comprises:

a layer of abradable material for cooperating by abrasion with the rotor of the compressor, the lattice being at least partially arranged in the radial thickness of the layer of abradable material, and said layer filling the lattice.

14. The axial flow turbine engine compressor in accordance with claim 13, wherein the airfoil comprises:

a fixing platform with a fixing shaft which is arranged radially opposite the lattice relative to the airfoil, the compressor further comprising:

an outer housing, the platform being fixed to the outer housing by means of the fixing shaft.

15. The axial flow turbine engine compressor in accordance with claim 13, wherein the wall is an inner shroud which is produced from a composite material having an organic matrix.

16. The axial flow turbine engine compressor in accordance with claim 13, wherein the wall comprises:

an upstream axial half and a downstream axial half, the lattice being axially spaced apart from one of the axial halves, the wall forming the inlet of the compressor.

17. An axial flow turbomachine, comprising:

an annular primary vein guiding a primary flow;

an annular secondary vein guiding a secondary flow, the secondary vein being around the primary vein;

an inner shroud embraced by the primary flow; and several annular rows of stator vanes, at least one of the stator vanes comprising:

an airfoil extending radially from the inner shroud through the primary flow; and a securing portion placed inside the inner shroud, the securing portion of the vane comprising:

a lattice which is secured inside the inner shroud in order to fix the vane to the wall via the lattice, wherein the lattice is a three-dimensional lattice with interconnected rods which are joined to each other so as to form meshes, the lattice comprising a plurality of meshes over the thickness and over the length of the airfoil and in the radial direction, wherein the airfoil comprises:

a solid body which extends over the majority of the radial height thereof, the lattice being broader in the circumferential direction than said airfoil.

* * * * *